US005709578A

United States Patent [19]

Hatsutori et al.

[11] Patent Number: 5,709,578

[45] Date of Patent: Jan. 20, 1998

[54] PROCESS OF MAKING COLD CATHODE FLUORESCENT TUBE

[75] Inventors: Masao Hatsutori, Daito; Masaharu Nishida, Kadoma, both of Japan

[73] Assignee: West Electric Co., Ltd., Osaka, Japan

[21] Appl. No.: 752,284

[22] Filed: Nov. 19, 1996

Related U.S. Application Data

[62] Division of Ser. No. 266,113, Jun. 27, 1994, which is a continuation of Ser. No. 881,794, May 12, 1992, abandoned.

[30] Foreign Application Priority Data

May 16, 1991 [JP] Japan ..... 3-111615

[51] Int. Cl.[6] ..... H01J 9/00

[52] U.S. Cl. ..... 445/26; 445/51; 445/9

[58] Field of Search ..... 445/26, 9, 51

[56] References Cited

U.S. PATENT DOCUMENTS

| | | | |
|---|---|---|---|
| 2,180,988 | 11/1939 | Lemmers et al. | 445/51 |
| 2,192,418 | 3/1940 | Sommer | 445/51 |
| 3,758,809 | 9/1973 | Menelly et al. | 313/491 |
| 3,798,492 | 3/1974 | Menelly | 313/491 |
| 4,303,846 | 12/1981 | Kimura et al. | 313/558 |
| 4,661,078 | 4/1987 | Grossman et al. | 445/9 |
| 4,808,136 | 2/1989 | Schuster | 445/9 |
| 5,138,224 | 8/1992 | Goldburt et al. | 313/491 |
| 5,214,351 | 5/1993 | Nieda | 313/619 |
| 5,520,560 | 5/1996 | Schiabel et al. | 445/9 |

FOREIGN PATENT DOCUMENTS

| | | | |
|---|---|---|---|
| 49-5659 | 2/1974 | Japan . | |
| 50-106468 | 8/1975 | Japan . | |
| 52-069551 | 6/1977 | Japan | 313/556 |
| 59-121750 | 7/1984 | Japan | 313/491 |
| 61-91849 | 5/1986 | Japan . | |

*Primary Examiner*—Kenneth J. Ramsey

*Attorney, Agent, or Firm*—Watson Cole Stevens Davis, P.L.L.C.

[57] ABSTRACT

A cold cathode fluorescent discharge tube is provided having, as an anode standing for one of discharge electrodes, a mercury discharge structure comprising a metal sintered body formed by sintering powder of a high melting point metal such as titanium, with mercury combined with the metal sintered body. The mercury discharge structure is so formed as to contain a large amount of mercury and is therefore permitted to have a compact shape in order to obtain a requisite amount of mercury. The cold cathode fluorescent discharge tube permits a sufficient amount of mercury to be sealingly incorporated in the interior of the tube without decreasing the ratio of the effective luminescent length to the total length, having suitability to diameter reduction, and can be produced at low cost.

45 Claims, 2 Drawing Sheets

PROCESS OF MAKING COLD CATHODE FLUORESCENT TUBE

This is a divisional of application Ser. No. 08/266,113 filed Jun. 27, 1994, which is a continuation of application Ser. No. 07/881,794, filed May 12, 1992 (abandonded).

BACKGROUND OF THE INVENTION

1. Field of the Invention

The present invention relates to a cold cathode fluorescent discharge tube having a tube sealingly incorporating a mercury discharge structure which is heated to discharge mercury contained in the structure and more particularly to a cold cathode fluorescent discharge tube having an anode of the construction which is advantageous to reduction of tube diameter.

2. Description of the Related Art

The cold cathode fluorescent discharge tube having a tube sealingly incorporating a mercury discharge structure for discharge of mercury has hitherto been well known. For example, JP-A-50-106468 discloses a discharge tube with a mercury discharge structure comprising of a metal base, a porous layer of Zr plus Zr alloy or Ti plus Ti alloy secured to the metal base, and mercury impregnated in the porous layer, the metal base and the porous layer being secured to each other through an alloy layer which is created at the interface and made of a constituent metal of the metal base and a constituent metal of the porous layer.

JP-A-61-91849 discloses a mercury charged fluorescent discharge tube of hermetic seal type comprising a glass tube having its inner surface coated with phosphor, a first electrode sealingly mounted to one end of the glass tube and including a first electrode member having the function of emission and getter and a metal cap jointed to the first electrode member, and a second electrode sealingly mounted to the other end of the glass tube and including a mercury alloy body serving as a mercury discharge structure and a metal cap joined with the mercury alloy body.

For example, as described in the specification of the last mentioned reference, a ribbon-shaped structure sold by SAES Inc. in Italy is well known as the mercury alloy body in the mercury charged fluorescent discharge tube and specifically, it is possible to use as the mercury alloy body a mercury vapor dischargeable getter device disclosed in JP-B-49-5659 and in which powder of a mercury vapor generative composition standing for an intermetallic compound of at least two kinds of metals selected from the group consisting of mercury, zirconium and titanium is pressed in or press fitted on an annular ring or a rigid support.

In each of the aforementioned examples, the mercury discharge structure is subjected to preparatory work such as bending and cutting in consideration of the diameter of a discharge tube used and an installation site of the structure within the tube, and thereafter it is disposed at the installation site and heated externally of the tube through a heating operation such as high frequency heating to discharge mercury contained in the structure to the interior of the tube.

As described above, the cold cathode fluorescent discharge tube having, within the tube, the mercury discharge structure for discharge of mercury is well known and practiced in various ways as a light source of liquid crystal backlighting apparatus and other lighting apparatus.

Incidentally, in various lighting apparatus inclusive of the aforementioned liquid crystal backlighting apparatus, reduction of the whole size has been desired in recent years, and further reduction of tube diameter has also been demanded strongly in the cold cathode fluorescent discharge tube serving as the light source.

Structurally, however, the mercury discharge structure sealingly incorporated in the tube of the conventional cold cathode fluorescent discharge tube uses a holder of any type for holding the mercury dischargeable compound, giving the following disadvantages to the diameter reduction of the discharge tube.

More particularly, the production process of discharge tubes such as the cold cathode fluorescent discharge tube usually includes such a high temperature applying step as a sealing step and the mercury discharge structure essentially has a disadvantage that it is affected by a high temperature applied during the high temperature applying step to unnecessarily discharge part of mercury impregnated in the structure.

Accordingly, during the preparatory work, the mercury discharge structure has to be worked for diameter reduction in consideration of the tube diameter, and its shape (size) necessary for obtaining a requisite amount of mercury has to be studied and determined by taking into account the unnecessary discharge amount of mercury, making the preparatory work operation very difficult and troublesome and consequently raising problems that the production cost of the mercury discharge structure is increased to raise the cost of the discharge tube.

On the other hand, as far as the diameter reduction of the discharge tube is presupposed, the shape of the mercury discharge structure in consideration of the stipulated amount of mercury and the aforementioned unnecessary discharge amount is determined as an elongated shape because no mercury is contained in the holder.

In other words, when the mercury discharge structure is reduced in diameter on the presupposition that the diameter of the discharge tube is reduced, the length of the structure must be increased to secure the stipulated amount of mercury, and as a result, the ratio of an effective luminescent length to the total length of the discharge tube is decreased disadvantageously. In addition, depending on the conditions of elongated length, a practically effective discharge tube will not be obtained.

SUMMARY OF THE INVENTION

An object of the invention is to provide an inexpensive cold cathode fluorescent discharge tube suitable for diameter reduction which can permit a sufficient amount of mercury to be sealingly incorporated in the tube without decreasing the ratio of the effective luminescent length to the total length of the discharge tube.

DESCRIPTION OF THE PREFERRED EMBODIMENTS

Figure 1:
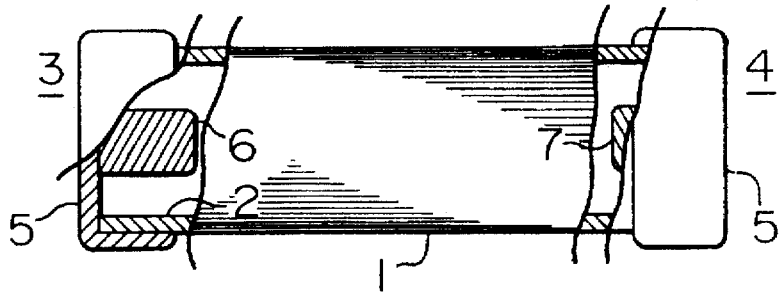
FIG. 1 is a front view, inclusive of a fragmentary section, showing an embodiment of a cold cathode fluorescent discharge tube according to the invention.

FIG. 1 is a front view, inclusive of fragmentary sections, showing an embodiment of a cold cathode fluorescent discharge tube according to the invention.

In the cold cathode fluorescent discharge tube of the invention, a glass tube 1 having its inner surface coated with phosphor 2 serves as an envelope, and electrodes 3 and 4 for discharging are sealingly connected to opposite ends of the glass tube 1.

In the discharge electrode 3 serving as an anode, a mercury discharge structure 6 for discharging mercury to the interior of the glass tube 1 is connected to a metal cap 5 by, for example, welding, and in the other discharge electrode 4 serving as a cathode, a sintered body 7 prepared by sintering, for example, tungsten is connected to a second metal cap 5 by welding.

As will be detailed later with further reference to FIGS. 2A–2C, the mercury discharge structure 6 includes a metal sintered body 9 formed by sintering metal powder 8 of one kind or a plurality of kinds of metals such as titanium, zirconium, tantalum and nickel, and mercury 10 combined with the metal sintered body 9.

Thus, the whole of the mercury discharge structure 6 per se can retain mercury, so that mercury can be contained in the structure 6 at a far larger amount than in the conventional mercury discharge structure of the same volume provided with the holder. In other words, the requisite amount of mercury can be obtained with a compact-shape structure, and as a result, the cold cathode fluorescent discharge tube according to the embodiment of the invention shown in FIG. 1 can realize very easily the diameter reduction of the tube without decreasing the ratio of the effective luminescent length to the total length.

A method for production of the mercury discharge structure 6 will now be described briefly.

Figure 2A:
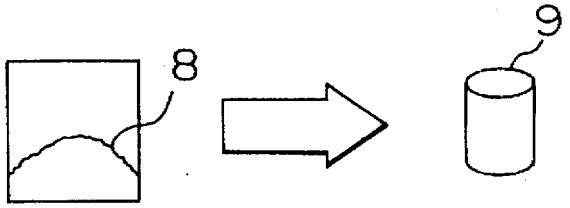
FIGS. 2A, 2B and 2C are schematic diagrams useful to explain an example of a method for production of a mercury discharge structure used for the cold cathode fluorescent discharge tube according to the invention, FIG. 2A illustrating a first step, FIG. 2B a second step and FIG. 2C a third step.
Figure 2B:
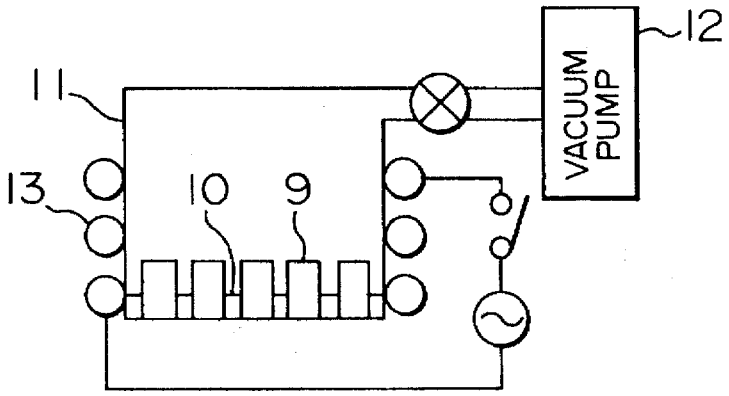
Figure 2C:
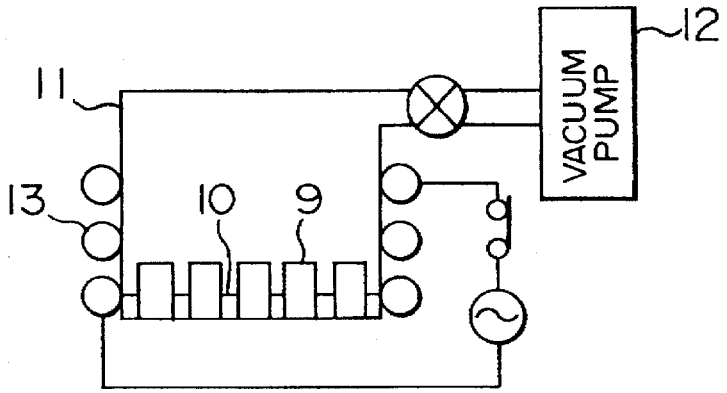

FIGS. 2A, 2B and 2C are schematic diagrams useful to explain an example of the method for production of the mercury discharge structure 6 used for the cold cathode fluorescent discharge tube according to the invention shown in FIG. 1.

Firstly, a first step is carried out as shown in FIG. 2A in which metal power 8 of one kind or a plurality of kinds of metals such as titanium, zirconium, tantalum and nickel is prepared and the metal powder 8 is sintered into a suitable shape, for example, a columnar shape in consideration of the tube diameter of a discharge tube used or a requisite amount of mercury to form a metal sintered body 9.

Subsequently, a second step is carried out as shown in FIG. 2B in which the metal sintered body 9 obtained through the first step is accommodated together with mercury 10 in a heating vessel 11 and the interior of the heating vessel 11 is evacuated to vacuum atmosphere by means of a vacuum pump 12.

After completion of the second step, a third step is carried out as shown in FIG. 2c in which the metal sintered body 9 and mercury 10 within the heating vessel 11 are heated at a temperature of from 800° to 900° C. for 3 to 4 hours by, for example, conducting electrical current through a high frequency coil 13 so as to be combined with each other.

Finally, after completion of the third step, a resulting structure is cooled and taken out of the heating vessel to provide a mercury discharge structure 6.

In the above example, the metal sintered body 9 and mercury 10 are sealingly incorporated directly in the heating vessel 11 which is usually made to be of a very large size. Therefore, in an alternative, the metal sintered body 9 and mercury 10 may be incorporated sealingly in a different enclosure defining vacuum atmosphere, and the third step for combining the metal sintered body 9 and mercury 10 may be carried out with the different enclosure placed within the heating vessel 11.

The mercury discharge structure 6 produced through the above production method is then welded to a metal cap 5 to form a discharge anode 3 in the embodiment shown in FIG. 1.

Since, as described previously, the mercury discharge structure 6 is formed by sintering powder of one kind or a plurality of kinds of high melting point metals such as titanium, zirconium, tantalum and nickel, it can be used as the discharge electrode 3 standing for the anode with no problem caused by such use.

By adopting, as the metal powder 8, metal powder of a mixture of titanium metal powder and nonvolatile getter metal powder such as zirconium, tantalum, nickel or barium, a mercury discharge structure 6 having the so-called getter effect of absorbing impurity gases can be obtained.

The production of the cold cathode fluorescent discharge tube per se of the embodiment according to the invention shown in FIG. 1 can obviously be done through various production methods including, for example, one disclosed in the aforementioned JP-A-61-91849 and will not be detailed herein.

Figure 3A:
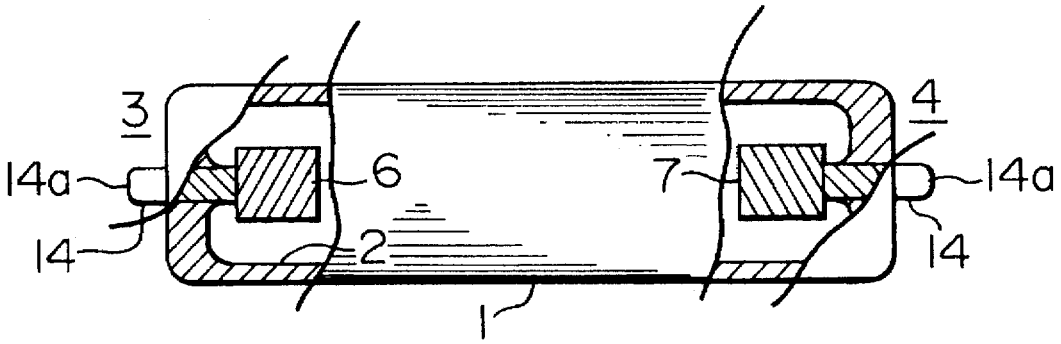
FIGS. 3A and 3B are front views, inclusive of fragmentary sections, showing cold cathode fluorescent discharge tubes according to further embodiments of the invention, respectively.
Figure 3B:
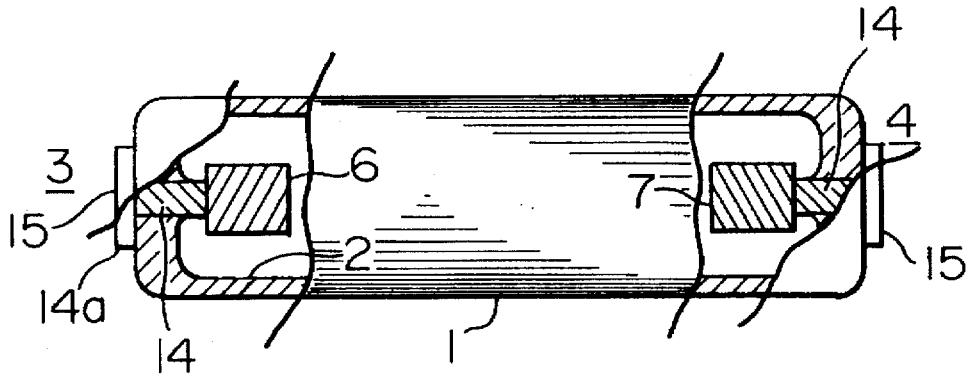

FIGS. 3A and 3B are front views, inclusive of fragmentary sections, showing further embodiments of the cold cathode fluorescent discharge tube according to the invention.

In the embodiment shown in FIG. 1, the mercury discharge structure 6 is welded directly to the metal cap 5 to form part of the discharge electrode 3 and the sintered body 7 is welded directly to a second metal cap 5 to form part of the discharge electrode 4. But in the embodiment shown in FIG. 3A, a mercury discharge structure 6 is welded to the other end of a metal rod 14 having one end 14*a* extending externally of a glass tube 1 to form a combined body which is used as a discharge electrode 3, and a sintered body 7 is welded to the other end of a second metal rod 14 having one end 14*a* extending externally of the glass tube 1 to form a combined body which is used as a discharge electrode 4.

In an alternative, the combined body of the mercury discharge structure 6 and metal rod 14 may be welded in turn to a metal cap 5 to form a discharge electrode 3, though not illustrated in the figure.

In the embodiment shown in FIG. 3B, one end 14*a* of the metal rod 14 extending externally of the glass tube 1 in the embodiment shown in FIG. 3A is welded to a metal flat plate 15, so that a mercury discharge structure 6, a metal rod 14 and a metal flat plate 15 are put together to form a combined body which is used as a discharge electrode 3, and a sintered body 7, a second metal rod 14 and a second metal flat plate 15 are put together to form a combined body which is used as a discharge electrode 4.

Figure 4A:
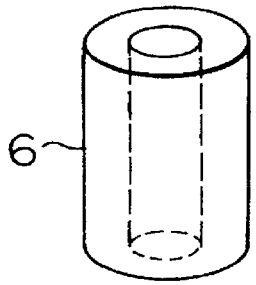
FIGS. 4A and 4B are perspective views showing further embodiments of the mercury discharge structure used for the cold cathode fluorescent discharge tube according to the invention.
Figure 4B:
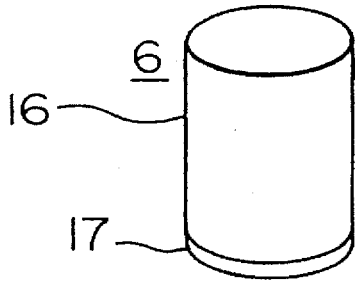

FIGS. 4A and 4B are perspective views showing further embodiments of the mercury discharge structure 6 used for the cold cathode fluorescent discharge tube according to the invention.

In the embodiment shown in FIG. 4A the columnar shape as a whole explained in connection with the embodiment of FIGS. 2A and 2B is modified to a cylindrical shape, whereby for example, when the cylindrical structure is welded to a metal cap 5 as in the embodiment of FIG. 1, the mercury discharge area can be increased, and besides, when the cylindrical structure has the getter effect, the area expected to contribute to the getter effect can be increased.

In the embodiment shown in FIG. 4B, for production of a metal sintered body 9, powder of a metal which will not be combined with mercury, for example, iron is prepared in addition to powder of a metal such as titanium described previously, and the two kinds of powder of metals, combinable and not combinable with mercury, are sintered in such a way that one thin end of a mercury discharge structure 6 is formed of the powder of metal not combinable with mercury.

More specifically, the structure 6 according to the embodiment shown in FIG. 4B is comprised of a preform 16 formed by sintering the powder of metal combinable with mercury and which contains mercury and a portion 17 formed by sintering the powder of metal not combinable with mercury and which does not contain mercury, whereby for example, when the structure is welded to a metal cap 5 as in the embodiment of FIG. 1, welding can be done at the portion 17 not containing mercury and so safety of welding operation can be promoted.

As described above, in the cold cathode fluorescent discharge tube according to the invention, the mercury discharge structure used as the anode standing for the discharge electrode and formed of the metal sintered body combined with mercury can dispense with the holder to attain an advantage of reduced volume, and for the same volume, it can contain a larger amount of mercury than the conventional structure provided with the holder. Consequently, even with a structure 6 of compact shape, the requisite amount of mercury can be obtained, and hence a sufficient amount of mercury can be discharged to the interior of the tube without decreasing the ratio of the effective luminescent length to the total length, thus advantageously realizing the diameter reduction of the tube very easily.

Further, in the cold cathode fluorescent discharge tube according to the invention, the amount of mercury to be contained in the mercury discharge structure used as the discharge electrode can be controlled by controlling the shape of the metal sintered body per se. Therefore, by controlling in advance the shape of the metal sintered body to a proper one in consideration of the conditions of use, the preparatory work such as bending and cutting can advantageously be avoided to save the cost, and the amount of mercury permitted to be discharged to the interior of the discharge tube during the production can advantageously be managed easily.

We claim:

1. A method of making a cold cathode fluorescent discharge tube having a cathode and an anode, said anode comprising a mercury discharge structure for discharging mercury within said discharge tube, said mercury discharge structure comprising a mercury alloy obtained by combining a metal sintered body with mercury, said method comprising:

(a) forming said metal sintered body by sintering powder of one kind or a plurality of kinds of metals combinable with said mercury into a desired shape which is predetermined according to a state of use of said anode, which results in a determination of a shape of said anode;

(b) combining said mercury with said metal sintered body which is sintered into said desired shape so as to provide said mercury alloy;

said mercury alloy being formed to have said desired shape of said metal sintered body when said metal sintered body and said mercury are combined with each other; and (c) sealing said mercury alloy thus formed within said discharge tube for use as said mercury discharge structure.

2. A method according to claim 1 wherein said desired shape is a column.

3. A method according to claim 1 wherein said desired shape is a cylindrical shape.

4. A method according to claim 1, wherein said one kind or plurality of kinds of metals are taken from a group consisting of titanium, zirconium, tantalum and nickel.

5. A method of making a cold cathode fluorescent discharge tube having a cathode and an anode, said anode comprising a mercury discharge structure for discharging mercury within said discharge tube, said mercury discharge structure including a mercury alloy, said method comprising:

(a) forming a metal sintered body by sintering a mixture of a first metal powder of titanium powder and a second metal powder of a non-volatile getter material powder into a desired shape which is predetermined according to a state of use of said anode, which results in a determination of a shape of said anode;

(b) combining mercury with said titanium powder of said metal sintered body which is sintered into said desired shape so as to provide said mercury alloy;

said mercury discharge structure, including said mercury alloy obtained by combining said titanium powder with said mercury, being formed to have said desired shape of said metal sintered body; and (c) thereafter sealing said mercury discharge structure within said discharge tube for use as said anode.

6. A method according to claim 5, wherein said second metal powder is powder of one kind or a plurality of kinds of metals taken from a group consisting of zirconium, tantalum and nickel.

7. A method according to claim 6 wherein said desired shape is a column.

8. A method according to claim 6 wherein said desired shape is a cylindrical shape.

9. A method according to claim 5 wherein said desired shape is a column.

10. A method according to claim 5 wherein said desired shape is a cylindrical shape.

11. A method of making a cold cathode fluorescent discharge tube having a cathode and an anode, said anode comprising a mercury discharge structure for discharging mercury within said discharge tube, said mercury discharge structure including a mercury alloy, said method comprising:

(a) forming a metal sintered body including (i) forming a first portion by sintering a first metal powder of one kind or a plurality of kinds of metals combinable with mercury and (ii) forming a second portion by sintering a second metal powder of a metal not combinable with mercury;

said metal sintered body being sintered to have a desired shape which is predetermined according to a state of use of said anode, which results in a determination of a shape of said anode, and said second portion forming a thin end portion of said desired shape;

(b) combining mercury with said first portion which is sintered into said desired shape so as to form said mercury alloy;

said mercury discharge structure, including said mercury alloy obtained by combining said first portion and said mercury, being formed to have said desired shape of said metal sintered body; and (c) thereafter sealing said mercury discharge structure within said discharge tube for use as a part of said anode.

12. A method according to claim 11, wherein step (c) comprises welding said metal sintered body through said second portion to a different member forming the anode.

13. A method according to claim 12 wherein said desired shape is a column.

14. A method according to claim 12 wherein said desired shape is a cylindrical shape.

15. A method according to claim 11 wherein said desired shape is a column.

16. A method according to claim 11 wherein said desired shape is a cylindrical shape.

17. A method according to claim 11, wherein said one kind or plurality of kinds of metals combinable with mercury are taken from a group consisting of titanium, zirconium, tantalum and nickel.

18. A method according to claim 11, wherein said metal not combinable with mercury is iron.

19. A method of making a cold cathode fluorescent discharge tube, said method comprising:

(a) providing a glass tube having on an inner surface a phosphor film;

(b) forming an anode, said anode having a metal powder sintered body, by (i) sintering a metal powder, said metal powder comprising a metal combinable with at least mercury to form a mercury alloy, said metal powder being shaped into a desired shape which is predetermined according to a state of use of said anode, which results in a determination of a shape of said anode, and (ii) combining mercury with said metal powder sintered body to form said mercury alloy so as to be contained in said metal powder sintered body, said mercury alloy, obtained by combining said metal powder sintered body with said mercury, being formed to have said desired shape of said metal powder sintered body;

(c) providing a cold cathode; and (d) sealingly mounting said anode and said cold cathode to opposite ends of said glass tube.

20. A method according to claim 19, wherein step (b)(i) comprises sintering powder of one kind or a plurality of kinds of metals taken from a group consisting of titanium, zirconium, tantalum and nickel.

21. A method according to claim 20 wherein said desired shape is a column which is concentrical with said glass tube.

22. A method according to claim 20 wherein said desired shape is a cylindrical shape.

23. A method according to claim 19, wherein step (b)(i) comprises sintering a mixture of a first metal powder of titanium and a second metal powder of a non-volatile getter material.

24. A method according to claim 23 wherein said desired shape is a column which is concentrical with said glass tube.

25. A method according to claim 23 wherein said desired shape is a cylindrical shape.

26. A method according to claim 19 wherein said desired shape is a column which is concentrical with said glass tube.

27. A method according to claim 19 wherein said desired shape is a cylindrical shape.

28. A method of making a mercury discharge structure for discharging mercury, said method comprising:

(a) forming a metal sintered body by sintering powder of one kind of metal or a plurality of kinds of metals into a desired shape which is predetermined according to a state of final use of said mercury discharge structure, which results in a determination of a shape of said mercury discharge structure, said one kind of metal or said plurality of kinds of metals including at least a metal which can form a mercury alloy by combining with mercury; and (b) combining mercury with said at least one metal contained in said metal sintered body which is sintered into the desired shape so as to form said mercury alloy;

said mercury discharge structure including said mercury alloy, obtained by combining said at least one metal contained in said metal sintered body with said mercury, being formed to have said desired shape of said metal sintered body.

29. A method according to claim 28, wherein said metal sintered body is formed by sintering metal powder of one or both of titanium and zirconium.

30. A method according to claim 28, wherein said metal sintered structure is formed by sintering into said desired shape a metal powder which is obtained by mixing a first metal powder of a metal which can form an alloy by combining with mercury and a second metal powder of a non-volatile getter material.

31. A method according to claim 28, wherein said metal sintered body is formed to have said desired shape by sintering metal powder which is obtained by combining:

a first metal powder including at least powder of a metal which can form an alloy by combining with mercury, and forming a first portion which can contain the mercury, and a second metal powder of a metal which cannot combine with the mercury, said second metal powder forming a second portion which is joined with said first portion and which cannot contain the mercury, said second portion having one end of said desired shape which is thinner than said first portion of said desired shape.

32. A method according to claim 31, wherein said second metal powder comprises one or more of zirconium, tantalum, nickel, and barium.

33. A method according to claim 32, wherein said second metal power is iron.

34. A method according to claim 28, wherein said metal sintered body is formed in a cylindrical shape.

35. A method of making a cold cathode fluorescent discharge tube having a mercury discharge structure built therein, said method comprising:

(a) providing an envelope having an end;

(b) forming a metal sintered body by (i) sintering metal powder including at least powder of a metal which can form a mercury alloy by combining with mercury, said metal sintered body being sintered into a desired shape which is predetermined according to a state of final use of said metal sintered body within said envelope, which results in a determination of a shape of said mercury discharge structure; and (ii) combining mercury with said at least powder of a metal which is contained in said metal sintered body which is sintered into the desired shape so as to form said mercury alloy;

said metal sintered body and said mercury being combined to form said mercury alloy to form said mercury discharge structure as a completed structure which has said desired shape of said metal sintered body;

(c) securing said mercury discharge structure to a metal cap or metal rod; and (d) sealingly attaching said mercury discharge structure and said mutual cap or metal rod to said end of said envelope.

36. A method according to claim 35, wherein said metal sintered body is formed by sintering metal powder taken from the group consisting of titanium, zirconium, and a mixture of both the titanium and zirconium.

37. A method according to claim 35, wherein said metal sintered body is formed by sintering, into said desired shape, metal powder which is obtained by mixing first metal powder of a metal which can form an alloy by combining with mercury with a second metal powder of a non-volatile getter material.

38. A method according to claim 37, wherein said first metal powder is taken from the group consisting of titanium, zirconium and a mixture of titanium and zirconium.

39. A method according to claim 37, wherein said second metal powder comprises one or more of zirconium, tantalum, nickel, and barium.

40. A method according to claim 35, wherein said metal sintered body is formed in a cylindrical shape.

41. A method of making a cold cathode fluorescent discharge tube, said method comprising:

(a) providing an envelope having on an inner surface a phosphor film;

(b) providing a pair of discharge electrodes respectively having metal caps or metal rods, at least one of said pair of discharge electrodes having a mercury discharge structure for discharging mercury within said envelope, said step of providing said pair of discharge electrodes comprising forming said mercury discharge structure by (i) forming a metal sintered body by sintering metal powder including at least powder of a metal which can form a mercury alloy by combining with mercury, said metal sintered body being sintered into a desired shape which is predetermined according to a state of final use of said metal sintered body within said envelope, which results in a determination of a shape of said mercury discharge structure, and being secured to the metal cap or metal rod; and (ii) combining mercury with said at least powder of a metal contained in said metal sintered body which is sintered into the desired shape so as to form said mercury alloy, said mercury alloy, obtained by combining said at least powder of a metal with said mercury, forming said mercury discharge structure as a completed structure, said completed structure having said desired shape of said metal sintered body; and (c) sealingly connecting said pair of discharge electrodes to opposite ends of said envelope.

42. A method according to claim 41, wherein said metal sintered body is formed in a cylindrical shape.

43. A method of making a mercury discharge body for discharging mercury, said method comprising:

(a) forming a metal molded body by molding powder of one kind of metal or a plurality of kinds of metals into a desired shape which determines a shape of said mercury discharge body, said one kind of metal or said plurality of kinds of metals including at least a metal which can form a mercury alloy by combining with mercury; and (b) combining mercury with said at least a metal contained in said metal molded body which is formed in the desired shape so as to form said mercury alloy;

said mercury discharge body including said mercury alloy and having said desired shape of said metal molded body.

44. A method of making a cold cathode fluorescent discharge tube having a mercury discharge structure built therein for use as a discharge electrode, said method comprising:

(a) providing an envelope having an end;

(b) forming a metal molded body by (i) molding metal powder including at least powder of a metal which can form a mercury alloy by combining with mercury, said metal molded body being molded into a desired shape which determines a shape of said metal molded body within said envelope; and (ii) combining mercury with said at least powder of a metal contained in said metal molded body which is molded into the desired shape so as to form said mercury alloy;

said metal molded body and said mercury being combined to form said mercury alloy to form said mercury discharge structure as a completed structure which has said desired shape of said metal molded body; and (c) sealingly connecting said mercury discharge structure and a metal cap or metal rod to said end of said envelope.

45. A method according to claim 44, wherein said metal sintered body is formed by sintering into said desired shape metal powder obtained by combining:

a first metal powder including at least powder of a metal which can form an alloy by combining with mercury, and forming a first portion which can contain the mercury, and a second metal powder of a metal which cannot combine with the mercury, said second metal powder forming a second portion which is joined with said first portion and which cannot contain the mercury, said second portion forming one end of said desired shape which is thinner than a remainder of said desired shape.

* * * * *